US006244065B1

(12) United States Patent
Wuestman

(10) Patent No.: US 6,244,065 B1
(45) Date of Patent: Jun. 12, 2001

(54) CONTAINER AND METHOD FOR REFRIGERATING A PRODUCT

(76) Inventor: Penny M. Wuestman, 622 Hillcrest Ct., West Dundee, IL (US) 60118

( * ) Notice: Subject to any disclaimer, the term of this patent is extended or adjusted under 35 U.S.C. 154(b) by 0 days.

(21) Appl. No.: 09/491,674

(22) Filed: Jan. 26, 2000

(51) Int. Cl.[7] ..... F25D 3/08

(52) U.S. Cl. ..... 62/457.6; 62/372; 62/459; 220/23.4

(58) Field of Search ..... 62/451.6, 457.5, 62/457.9, 372, 459; 220/23.4, 571

(56) References Cited

U.S. PATENT DOCUMENTS 2,507,425 * 5/1950 Swartout .
3,130,288 * 4/1964 Monaco et al. .
3,241,706 * 3/1966 Manaco et al. .
3,670,916 * 6/1972 Alpert .
4,005,586 2/1977 Lyons .
4,544,022 10/1985 Tomae .
4,688,398 * 8/1987 Baek .
5,231,850 * 8/1993 Morris ..... 62/457.6
5,372,274 12/1994 Freedland .
5,611,206 3/1997 Sargent .
5,701,757 * 12/1997 Heverly ..... 62/457.6 X
5,727,857 * 3/1998 Smith .

* cited by examiner

*Primary Examiner*—Michael Powell Buiz
*Assistant Examiner*—Chen-Wen Jiang
(74) *Attorney, Agent, or Firm*—Charles F. Meroni; Meroni & Meroni, P.

(57) ABSTRACT

The present invention provides a device for containing and a method of refrigerating, heating, and storing. The device comprises at least two containers each having a continuously formed rounded surface running from a bottom plane to a medial perimeter. The continuously formed rounded surface of one of the containers laterally extends beyond the medial perimeter of at least the two containers and extends over and laterally at opposite ends of the containers in a parallel relationship for suspending the one container within one of the other containers. A notched cap is sized for placement over and for substantially encapsulating the two containers. The continuously formed rounded surface of the one container laterally extends through and laterally beyond the notched cap.

25 Claims, 3 Drawing Sheets

CONTAINER AND METHOD FOR REFRIGERATING A PRODUCT

BACKGROUND OF THE INVENTION

1. Field of the Invention

The present invention relates to devices for refrigerating, heating, and storing substances for subsequent usage and a method of refrigerating, heating, and storing using the concepts of the present invention. More specifically, the present invention is primarily intended as a container for storing a substance in a controlled self-sustaining environment within another container and for removing the container and the substance from the other container for subsequent usage or consumption of the substance.

2. Description of the Related Art

The preservation of substances, such as food items, form a significant advancement in modern civilization. For example, modern development in refrigeration, heating, and storage techniques have provided various devices for the preservation and subsequent consumption of food. Among the food items requiring refrigeration, heating, and storage is butter, margarine, and other "spreads". Whether for cooking or for serving, the preservation of butter and the like present unique problems, not applicable to other condiments, such as ketchup, salt, sugar and so forth. For example, when using butter and the other "spreads" in cooking, the butter and spreads are often required to be melted or soften prior to their addition to the recipe. However, when served directly at the meal, butter and "spreads" are usually required to be chilled and maintained in a solid state. In an effort to provide for these requirements, many devices have been developed for refrigeration for use with butter and spreads.

U.S. Pat. No. 4,005,586, which issued to Lyons, discloses a Refrigerated Butter Dish, known as Butter Bell Crock™. The dish dispenser comprises a receptacle for containing crushed ice and an invertable cover unit which has on one side thereof a handle for lifting the cover and on the other an outwardly extending tapered skirt defining interiorly thereof a butter receiving chamber. When the dispenser is not being used, the cover is positioned so that the skirt portion depends inwardly of the receptacle, keeping the butter contained therein in close proximity with the crushed ice. When it is desired to remove the butter from the dispenser, the cover is inverted so that the skirt portion extends upwardly, making the butter chamber readily accessible to the user. However, as the '586 dispenser requires that the skirt be inverted 180 degrees for removing the butter and returned to an upside-down position for storing the butter against the ice, the '586 dispenser is susceptible to mixing of the butter with any melted ice and is impractical for refrigerating melted or softened butter, that may fall out of the skirt when turned upside-down.

Moreover, U.S. Pat. No. 5,372,274, which issued to Freedland, discloses a Container for the Storage and Serving of Food Products comprising an outer bowl, and an inner bowl receivable within the outer bowl such that a space is defined between the outer and inner bowls for containing ice or hot packs for cooling or heating the walls of the inner bowl. The '274 device also comprises a drain assembly for selectively draining excess salad dressing or water out of the inner bowl and the drain assembly is formed in part from a bottom wall portion of the inner bowl and a drain cover plate that is slidably mounted over the wall portion. Both the bottom wall portion of the inner bowl and the drain cover plate include mutually registrable patterns of drain ports which may be slidably moved into alignment when drainage of the inner bowl is desired. However, the usage of a drain system in the bottom of the inner bowl can allow for melted or softened food products, like butter and spread, to spill or drain unnecessarily or unwantingly from the '274 device.

It is therefore important and necessary that a container be developed that can refrigerate, heat, and store substances, such as butter and "spreads" for use in cooking, serving, and the like. Moreover, the container would provide a controlled self-sustaining environment minimizing unnecessary spillage while maximizing refrigeration and heating of the substance. The container can also be portable, efficient, and separable for storing and serving the substance contained therein.

Other objects of my invention, as well as particular features, elements, and advantages thereof, will be elucidated in, or apparent from, the following description and the accompanying drawing figures.

SUMMARY OF THE INVENTION

The present invention provides a container and a method for refrigerating, heating, or storing a substance, such as butter or "spread". According to the present invention a container is provided and comprises a first piece configured for retaining liquids and having an elliptically contoured outer surface and an interior. A second piece is provided and is also configured for retaining liquids. The second piece has two oppositely positioned handles for contacting and for laterally extending beyond the first piece and the second piece is capable of suspended placement within the interior of the first piece. A third piece is provided for placement on the first piece for encapsulating the first piece and the second piece.

The present invention also provides a device for containing comprising at least two containers, each having a continuously formed rounded surface running from a bottom plane to a medial perimeter. The continuously formed rounded surface of one container laterally extends over and laterally beyond the medial perimeter of the two containers and at opposite ends of the two containers in a parallel relationship for suspending the one container within one of the other containers. A notched cap is also provided and is sized for placement over and for substantially encapsulating the two containers. The continuously formed rounded surface of the one container laterally extends through and laterally notched beyond the cap.

In another embodiment, the present invention provides a device for containing comprising a first container that has a continuous bowl-shaped surface and opposing ends. A second container having a continuous bowl-shaped surface is also provided and may be securely suspended within the first container the second container including mounting ridges for imparting secure contact with the opposing ends of the first container while contacting the opposing ends of the first container. A third container may be notched and inverted for placement on the first container for housing the second container and for sealing the first and second containers.

In a further embodiment of the present invention a temperature control and stacked storage system is provided and comprises: a plurality of open-top containers that have substantially similar shapes and continuous tapered surfaces. At least one of the containers is sized for suspended secure placement within another of the containers. The suspended secure placement defines a cavity therebetween for heating or cooling mediums. A notched cover container may be inverted for placement upon the plurality of open-top containers. The notched cover container can cover all but a handle portion of the container that is sized for suspended secure the handle portion extending through the notched cover container placement. The cover container may seal the heating and cooling mediums located within the plurality of open-top containers.

Finally, the present invention provides a method of refrigerating, heating, and storing comprising the acts of: first, providing a first container having a continuous bowl-shaped interior and an upper rim and then filling the first piece with a heating or cooling medium, such as hot water or ice. The next act is providing a second container having a continuous bowl-shaped exterior a mounting ridge located along the continuous bowl-shaped exterior, and a plurality of handles and then filling the second container with a substance, such as food. Next is placing the second container and substance into the first container, resting the plurality of handles on the upper rim while contacting the continuous bowl-shaped interior with the mounting ridges for positioning and securing the second container within the first container, and suspending the second container therein. The act of placing then leads to creating a cavity between the continuous bowl-shaped exterior of the second container and the continuous bowl-shaped interior of the first container and resting the second container upon the heating or cooling medium. The final acts are inverting a cap having a perimeter edge, placing the perimeter edge upon the upper rim, and covering the first container and the heating or cooling medium, and the second container and the substance with the cap.

The present invention, therefore provides a container that can refrigerate, heat, and store substances, such as butter and "spreads" for use in cooking, serving, and the like. Moreover, the container can provide a controlled self-sustaining environment minimizing unnecessary spillage while maximizing refrigeration and heating of the substance. The container can also be portable, efficient, and separable for storing and serving the substance contained therein.

DESCRIPTION OF THE DRAWINGS

Other features of my invention will become more evident from a consideration of the following detailed description of my patent drawings, as follows.

DETAILED DESCRIPTION OF THE PREFERRED EMBODIMENT

Figure 1:
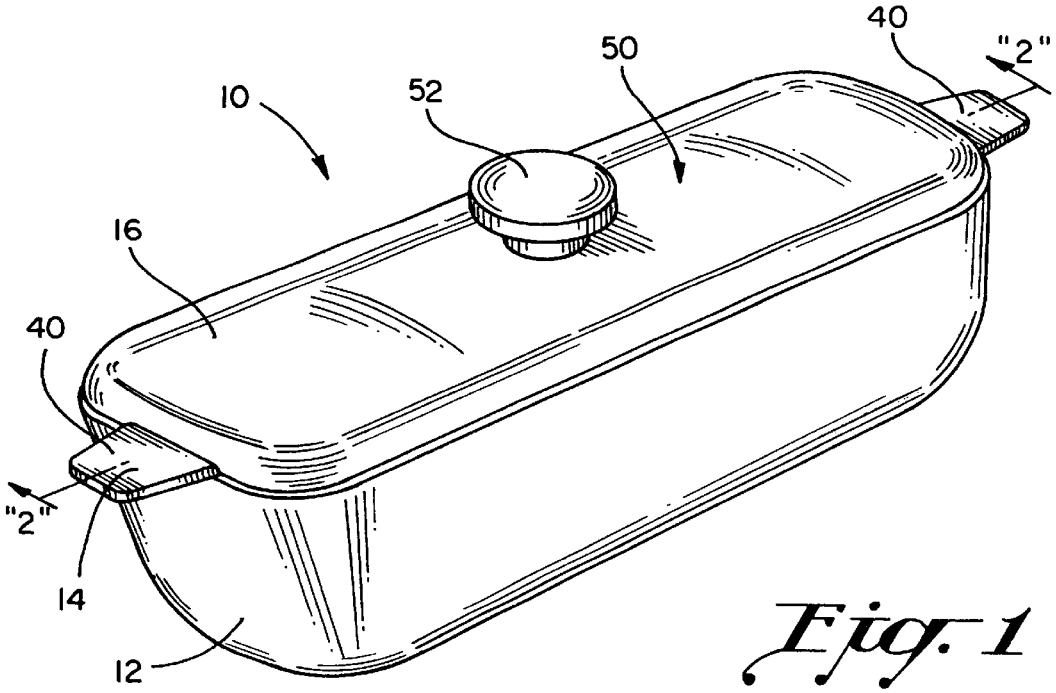
FIG. 1 is a perspective view of an embodiment of the present invention showing a cap covering first and second containers.

Referring now to the drawings, the present invention concerns a container for refrigerating, heating, and storing a substance, such as butter or "spread", illustrated by way of example in FIGS. 1–9. It is not intended that the present invention be limited solely to containers for use with food items, rather it is intended that the scope of the present invention also includes containers for refrigerating, heating, and storing substances such as medical products, plant products, pet products, and the like.

As is illustrated in FIGS. 1–9, in an embodiment of the present invention, a container 10, which is also known as a Butter Boat™, comprises a first piece or container 12, a second piece or container 14, and a third piece or cap 16. The first piece 12, as is shown in FIGS. 1–3 and 8–9, is an open-top container, like a bowl-shaped container, configured for retaining liquids without having a drain. In other words, the first piece 12 has a continuously formed rounded surface 18 that can run from a bottom plane 20 to a medial perimeter 22 and can have an oblong, rectangular, or elliptically contoured outer surface or shape 24, although other shapes are contemplated within the scope of the present invention. The first piece 12 also has an interior 26 that can taper from the elliptically contoured outer surface 24 to a bottom surface 28 of the first piece. The first piece 12 also has opposing ends 30 that can be located along the shorter dimension of the first piece 12.

The second piece 14, as is shown in FIGS. 1–3 and 6–7, is also an open-top container, like a bowl-shaped container, configured for retaining liquids without having a drain and is substantially similar in structure to the first piece 12. The second piece 14 has a continuously formed rounded surface 32 that can run from a bottom plane 34 to a medial perimeter 36 and can have an oblong or elliptically contoured outer surface or shape 38.

Figure 2:
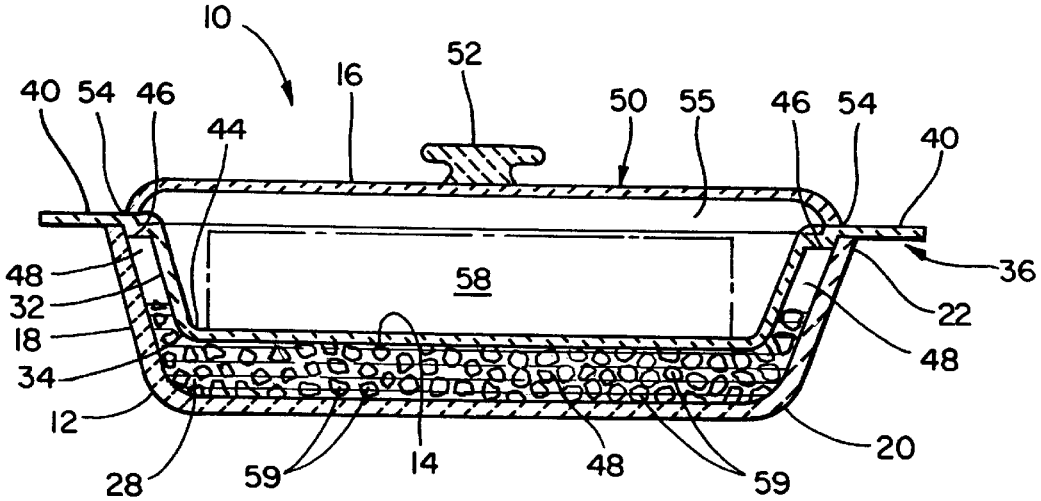
FIG. 2 is a cross-sectional view of the embodiment of FIG. 1 showing the suspended placement of the second container within the first container including a cavity defined therein.
Figure 3:
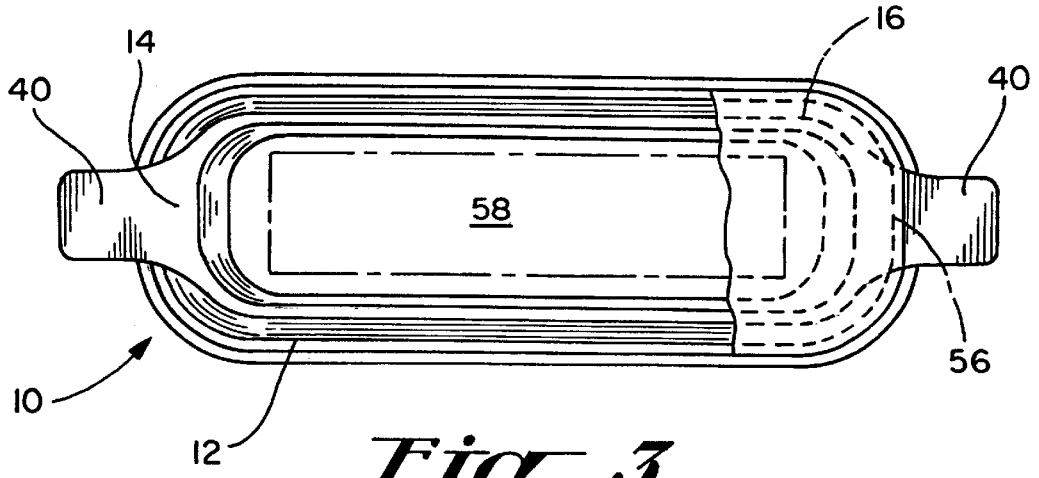
FIG. 3 is a top view of an embodiment of the present invention showing the interaction of the components of the present invention with the components partially shown in phantom where covered by the cap.
Figure 4:
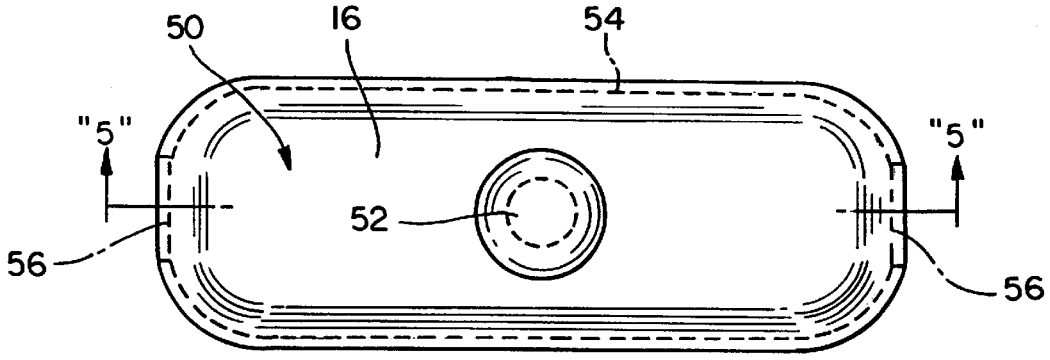
FIG. 4 is a top view of the cap showing notches and edges.
Figure 5:
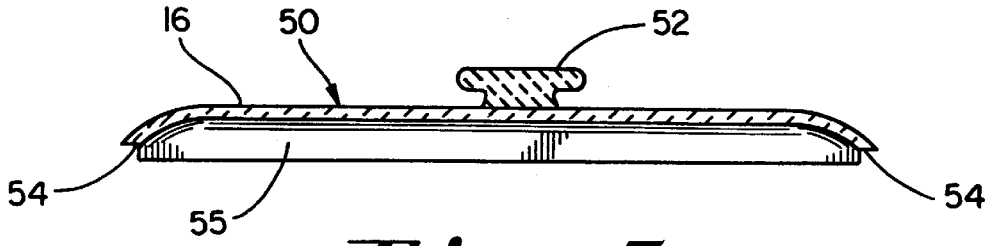
FIG. 5 is a cross-sectional view of the cap of FIG. 4.

In addition, a significant aspect of the present invention is that the second piece 14 is sized for placement within the interior 26 of the first piece 12 in a removable stacking relationship, as is shown in FIGS. 1–3. In other words, the second piece 14 can be stacked inside of the first piece 12 and then removed, when needed, for independent usage, as will be described in greater detail to follow. The second piece 14 also has two oppositely positioned handles 40 for contacting the first piece 12 along the opposing ends 30 and for supporting the second piece 14 thereon. The handles 40 can be an extension of the continuously formed rounded surface 32 that can laterally extend from the medial perimeters 22 and 36 and elliptically contoured outer surfaces 24 and 38 for easy grasp and removal of the second piece 14 from the first piece 12. The elliptically contoured outer surface 38 also tapers from the handles 40 to a bottom surface 44. The handles 40 can extend parallel to the bottom surface 44.

Figure 7:
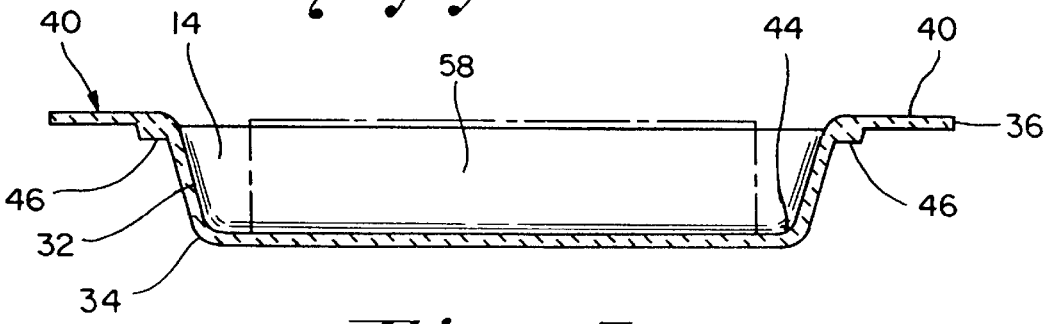
FIG. 7 is a cross-sectional view of the second container of FIG. 6 showing placement therein of a substance, such as food.
Figure 8:
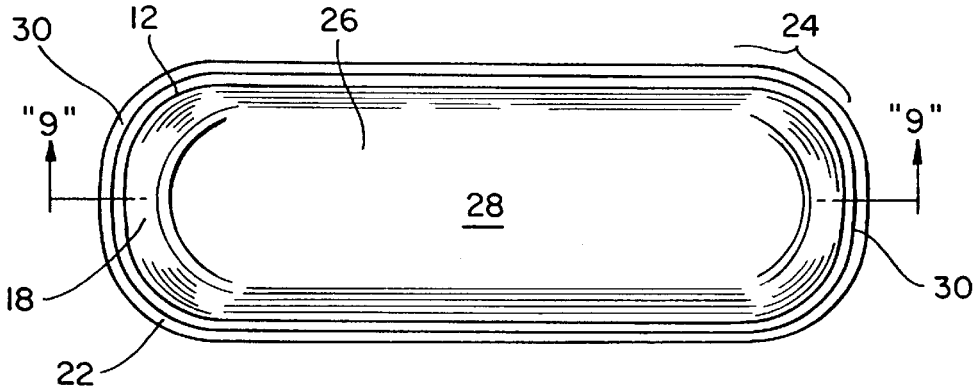
FIG. 8 is a top view of the first container showing a tapered interior surface.
Figure 9:
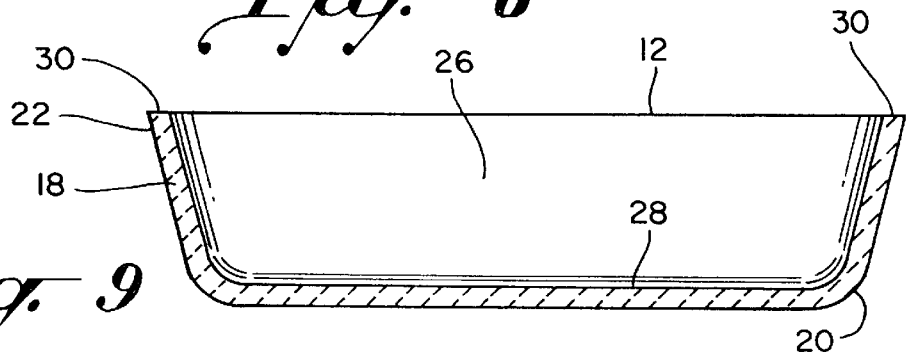
FIG. 9 is a cross-sectional view of the first container of FIG. 8.

As to the stacking relationship, mounting ridges 46, shown in FIGS. 2 and 7 can be placed adjacent to the handles 40 on the continuously formed rounded surface 32 for positioning the second piece 14 within or inside in the interior 26 of the first piece 12 in a suspended placement relationship relative to the first piece 12. The second piece 14 can thereafter be removed from the first piece 12 for independent usage. The contact of the handles 40 with the medial perimeter 22 of the first piece 12 can support the second piece 14 in the suspended placement relationship.

Another important feature of the present invention is that when stacked and placed in the suspended placement relationship, the bottom surfaces 28 and 44 can then be positioned parallel to one another, as is shown in FIG. 2. The bottom surfaces 28 and 44 then define a cavity 48 when the bottom surfaces 28 and 44 are positioned parallel to one another, as is illustrated in FIG. 2. The cavity 48 can extend in between substantially all of the interface between the first piece 12 and the second piece 14, including along substantially all of the continuously formed rounded surfaces 18 and 32. This spacing along all sides of the second piece 14 and the first piece 12 can be maintained by the mounting ridges 46. It is important also, that both the first piece 12 and the second piece 14 are placed in the suspended relationship with the open-top facing in the same direction, generally upwards. Therefore, the second piece 14 need not be inverted for placement in or removal out of the first piece 12.

Finally, the third piece or cap 16 can be provided and sized for placement on the first piece 12 for substantially encapsulating, housing, and sealing the first piece 12 and the second piece 14, as is shown in FIGS. 1–3. The third piece 16, illustrated in FIGS. 1–5, has an upper outer surface 50 and a lifting protrusion 52 located thereon for removing or placing the third piece 16 on the stacked pieces 12 and 14. The third piece 16 also has an elliptically shaped bottom rim 54 substantially similar to the elliptically contoured outer surface 24 of the first piece 12 for contacting the first piece 12 and for supporting the third piece 16 thereon. The upper outer surface 50 of the third piece 16 can taper from the lifting protrusion 52 towards the elliptically shaped bottom rim 54 defining an interior cavity 55 thereunder. The interior cavity can add additional capacity to the cavity 48 as a container when the third piece 16 is inverted and placed upon the first piece 12 in this inverted manner, as is shown in FIGS. 1–2.

Moreover, the handles 40 of the second piece 14 not only can extend beyond the medial perimeter 36, but can extend beyond the elliptically shaped bottom rim 54 of the third piece 16 when encapsulating the first and second pieces 12 and 14. Therefore, the third piece 16 can also have at least one notch 56 sized for placement of the third piece 16 over the handles 40 of the second piece 14 for enhancing the seal within the container 10.

As to construction, the container 10 and the first piece 12, the second piece 14, and the third piece 16 can be constructed of ceramic, metal, stainless steel, plastic, glass and so forth. The material chosen should provide the features of the present invention. If used for food 58 for example, such as butter and "spreads", illustrated in FIGS. 2–3 and 6–7, the material chosen should provide a medium for transmitting heat or cold from a heating or cooling medium 59 located in the cavity 48 to the food 58 located in the second piece 14. Heating or cooling mediums 59 may include ice, water, dry ice, commercial products, and so forth. The container 10 may function without transmitting fluids directly to the food 58, such as water from melting ice, creating a mess, or requiring that the second piece 14 be inverted and the food 58 spilled. A line of demarcation may also be added for aiding the filling of the first piece 12 with the heating or cooling medium 59 without overfilling the same.

With the oblong or elliptical shape, the container 10 can also provide a tailored-containing device for butter and spreads, that with the addition of the cap 16, looks like a boat and suspends the food 58 above the heat or cold. This tailored shape may also place the heat or cold of the heating or cooling medium 59 located in the cavity 48 closer to the food 58 that is located within the second piece 14. In fact, with the extension of the cavity 48 along the bottom surfaces 28 and 44 and up substantially all of the continuously formed rounded surfaces 18 and 32, the heat and cold of the heating or cooling medium can be extended nearly all around the food 58 for improved food preparation or preservation by immersion of the second piece 14 and the food 58 in the heat or cold.

Figure 6:
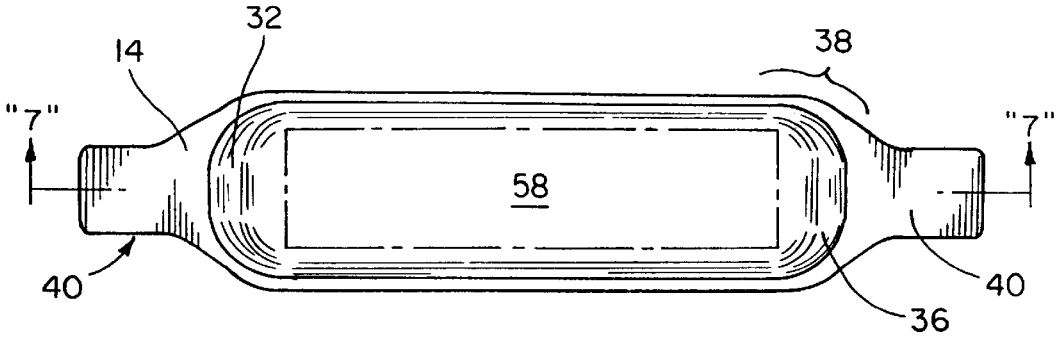
FIG. 6 is a top view of the second container showing the shape, surface, and handles of the second container.

The cap 16 may then be placed on top of the first piece 12 and the second piece 14, as is shown in FIGS. 1–3, and the cap 16 may create a seal or insulator for keeping the cold or heat inside of the container 10 for self-sustaining refrigeration, melting, or heating. The cap and choice of materials may also maintain that self- sustaining refrigeration, melting, or heating for a longer period of time. In addition, once the food 58 or substance is needed for use or for serving, for example, the second container 14 can be removed from the container 10 and can be used separately and independently of the other parts of the container 10. In one embodiment, the separate usage may include use as a butter tray, as is illustrated in FIGS. 6–7. In another embodiment, the second container 14 may be used as a microwave tray. Hence, the present invention can provide a temperature control and stacked storage system for multiple usages in multiple temperatures and multiple arts.

Finally, in usage the present invention provides a method of refrigerating, heating, and storing as is illustrated in FIGS. 1–3 and 6–7. The method comprises the acts of: first, providing the first container 12 having the continuous bowl-shaped interior 18 and the upper rim 22. The first piece 12 may then be filled the heating or cooling medium 59 followed by the act of providing the second container 14 that has the continuous bowl-shaped exterior 32 and the plurality of handles 40. Next is filling the second container 14 with the substance 58 and placing the second container 14 and the substance 58 into the first container 12, resting the plurality of handles 40 on the upper rim 22, and suspending the second container 14 inside of the first container 12. Placement of the second container 14 inside of the first container 12 can then create the cavity 48 between the continuous bowl-shaped exterior 32 and the continuous bowl-shaped interior 18 and the location for resting the second container 14 upon the heating or cooling medium 59. The final acts can then be inverting the cap 16 having the perimeter edge 54 and placing the perimeter edge 54 upon the upper rim 22 and covering the first container 12 and the heating or cooling medium 59 and the second container 14 and the substance 59 with the cap 16.

To use the second container 14 separately, the acts include removing the cap 16 from the first container 12 and removing the second container 14 for using the substance 58. Removing the second container 14 can also further comprise removing the continuous bowl-shaped exterior 32 from the heating or cooling medium 59 and lifting the second container 14 out of the first container 12 for placement on a separate surface for usage of the substance 58. Moreover, the act of placing the second container 14 comprises positioning the continuous bowl-shaped exterior 32 adjacent the heating or cooling medium 59 in the cavity 48 without contacting the continuous bowl-shaped interior 18.

In construction and in use the present invention therefore provides a container that can refrigerate, heat, and store substances, such as butter and "spreads" for use in cooking, serving, and the like. Moreover, the container can provide a controlled self-sustaining environment minimizing unnecessary spillage while maximizing refrigeration and heating of the substance. The container can also be portable, efficient, and separable for storing and serving the substance contained therein.

As various possible embodiments may be made in the above invention for use for different purposes and as various changes might be made in the embodiments and methods above set forth, it is understood that all of the above matters here set forth or shown in the accompanying drawings are to be interpreted as illustrative and not in a limiting sense.

What is claimed is:

1. A container comprising:

a first piece configured for retaining liquids and having an elliptically contoured outer surface and an interior;

a second piece configured for retaining liquids and having two oppositely positioned handles for contacting the first piece, the second piece capable of suspended placement within the interior of the first piece, the two oppositely positioned handles configured for laterally extending beyond the contact with the first piece; and a third piece for placement on the first piece for encapsulating the first piece and the second piece.

2. The container of claim 1, wherein the handles contact the first piece for supporting the second piece in suspended placement.

3. The container of claim 1, wherein the first piece and the second piece each have a bottom surface and the bottom surfaces are positioned parallel to one another when the second piece is placed in suspended placement within the interior of the first piece.

4. The container of claim 3, wherein the bottom surfaces define a cavity when the bottom surfaces are positioned parallel to one another.

5. The container of claim 1, wherein the second piece has an elliptically contoured outer surface substantially similar to the elliptically contoured outer surface of the first piece and sized for placement within the interior.

6. The container of claim 5, wherein the elliptically contoured outer surface of the second piece tapers from the handles to a bottom surface.

7. The container of claim 6, wherein the interior of the first piece tapers from the elliptically contoured outer surface of the first piece to a bottom surface of the first piece.

8. The container of claim 1, wherein the handles contact the first piece for supporting the second piece in suspended placement, the first piece and the second piece each have a bottom surface and the bottom surfaces are positioned parallel to one another when the second piece is placed in suspended placement within the interior of the first piece.

9. A container comprising:

a first piece configured for retaining liquids and having an elliptically contoured outer surface and an interior;

a second piece configured for retaining liquids and having two oppositely positioned handles for contacting the first piece, the second piece capable of suspended placement within the interior of the first piece; and a third piece for placement on the first piece for encapsulating the first piece and the second piece, the third piece having a lifting protrusion along an upper outer surface, an elliptically shaped bottom rim substantially similar to the elliptically contoured outer surface of the first piece for contacting the first piece and for supporting the third piece thereon, and at least one notch sized for placement of the third piece over the handles of the second piece.

10. The container of claim 9, wherein the upper outer surface of the third piece tapers from the lifting protrusion towards the elliptically shaped bottom rim defining an interior cavity.

11. A container comprising:

a first piece configured for retaining liquids and having an elliptically contoured outer surface and an interior;

a second piece configured for retaining liquids and having two oppositely positioned handles for contacting the first piece, the second piece capable of suspended placement within the interior of the first piece; and a third piece for placement on the first piece for encapsulating the first piece and the second piece, the two oppositely positioned handles of the second piece extending beyond the elliptically contoured outer surface of the first piece and an elliptically shaped bottom rim of the third piece when encapsulating the first and second pieces.

12. A device for containing comprising:

at least two containers each having a continuously formed rounded surface running from a bottom plane to a medial perimeter, the continuously formed rounded surface of one container laterally extending over and laterally beyond the medial perimeter of the at least two containers at opposite ends of the at least two containers in parallel relationship for suspending the one container within one of the other containers; and a notched cap sized for placement over and for substantially encapsulating the at least two containers, the continuously formed rounded surface of the one container laterally extending through and laterally beyond the notched cap.

13. The device of claim 12, wherein the continuously formed rounded surface is oblong.

14. The device of claim 12, wherein the continuously formed rounded surface is elliptical.

15. The device of claim 12, wherein the continuously formed rounded surface of the one container includes at least one handle laterally extending beyond the cap.

16. The device of claim 12, wherein the one container suspended within one of the other containers is removable from the other containers for independent usage.

17. The device of claim 12, wherein at least the two containers define a chamber between the continuously formed rounded surface of each container when the one container is suspended within the one of the other containers.

18. A device for containing comprising:

at least two containers each having a continuously formed rounded surface running from a bottom plane to a medial perimeter, the continuously formed rounded surface of one container laterally extending beyond the medial perimeter of the at least two containers at opposite ends of the at least two containers in parallel relationship for suspending the one container within one of the other containers; and a cap sized for placement over and for substantially encapsulating the at least two containers, the continuously formed rounded surface of the one container laterally extending beyond the cap and including at least one handle laterally extending beyond the cap and a mounting ridge along the at least one handle for positioning the one container within the other container.

19. A device for containing comprising:

a first container having a continuous bowl-shaped surface and opposing ends;

a second container having a continuous bowl-shaped surface sized for secure suspended relation within the first container while contacting the opposing ends of the first container, the second container including mounting ridges for imparting secure contact with the opposing ends of the first container; and a third container notched and inverted for secure placement on the first container and for housing the second container.

20. A method of refrigerating, heating, and storing comprising the acts of:

providing a first container having a continuous bowl-shaped interior and an upper rim;

filling the first piece with a heating or cooling medium;

providing a second container having a continuous bowl-shaped exterior, a plurality of handles, and a mounting ridge located along the continuous bowl-shaped exterior;

filling the second container with a substance;

placing the second container and substance into the first container, resting the plurality of handles on the upper rim while contacting the continuous bowl-shaped interior with the mounting ridges for positioning and securing the second container within the first container, and suspending the second container therein;

creating a cavity between the continuous bowl-shaped exterior of the second container and the continuous bowl-shaped interior of the first container and resting the second container upon the heating or cooling medium;

inverting a cap having a perimeter edge and placing the perimeter edge upon the upper rim; and covering the first container and the heating or cooling medium and the second container and the substance with the cap.

21. The method of claim 20, further comprising removing the cap from the first container and removing the second container for using the substance.

22. The method of claim 21, wherein removing the second container further comprises removing the continuous bowl-shaped exterior from the heating or cooling medium and lifting the second container out of the first container for placement on a separate surface for usage of the substance.

23. The method of claim 20, wherein placing the second container comprises positioning the continuous bowl-shaped exterior adjacent the heating or cooling medium in the cavity without contacting the continuous bowl-shaped interior.

24. A temperature control and stacked storage system comprising:

a plurality of open-top containers having substantially similar shapes and continuous tapered surfaces, at least one of the containers being sized for suspended secure placement within another of the containers, the suspended secure placement defining a cavity therebetween for heating or cooling mediums; and a notched cover container inverted for placement upon the plurality of open-top containers, the notched cover container for covering all but a handle portion of the container sized for suspended secure placement, the handle portion extending through the notched cover container, the cover container for sealing the heating and cooling mediums located within the plurality of open-top containers.

25. A container comprising:

a first piece configured for retaining liquids and having an elliptically contoured outer surface and an interior;

a second piece configured for retaining liquids and having two oppositely positioned handles for contacting the first piece, the second piece capable of suspended placement within the interior of the first piece; and a third piece for placement on the first piece for encapsulating the first piece and the second piece, the two oppositely positioned handles contacting the first piece for supporting the second piece in suspended placement, the first piece and the second piece each having a bottom surface and the bottom surfaces being positioned parallel to one another when the second piece is placed in suspended placement within the interior of the first piece, the third piece having a lifting protrusion along an upper outer surface, an elliptically shaped bottom rim substantially similar to the elliptically contoured outer surface of the first piece for contacting the first piece and for supporting the third piece thereon, and at least one notch sized for placement of the third piece over the two oppositely positioned handles of the second piece.

* * * * *